US006028399A

United States Patent [19]

Moisin

[11] Patent Number: 6,028,399

[45] Date of Patent: Feb. 22, 2000

[54] BALLAST CIRCUIT WITH A CAPACITIVE AND INDUCTIVE FEEDBACK PATH

[75] Inventor: Mihail S. Moisin, Brookline, Mass.

[73] Assignee: Electro-Mag International, Inc.

[21] Appl. No.: 09/102,789

[22] Filed: Jun. 23, 1998

[51] Int. Cl.[7] ..... H05B 37/00

[52] U.S. Cl. ..... 315/224; 315/307; 315/276

[58] Field of Search ..... 315/307, 291, 315/224, 209 R, 276, DIG. 7

[56] References Cited

U.S. PATENT DOCUMENTS

| | | | |
|---|---|---|---|
| 3,808,481 | 4/1974 | Rippel | 318/139 |
| 4,115,729 | 9/1978 | Young et al. | 322/86 |
| 4,164,785 | 8/1979 | Young et al. | 363/50 |
| 4,270,164 | 5/1981 | Wyman et al. | 363/56 |
| 4,415,839 | 11/1983 | Lesea | 315/308 |
| 4,423,363 | 12/1983 | Clark et al. | 318/375 |
| 4,480,298 | 10/1984 | Fry | 307/31 |
| 4,489,373 | 12/1984 | du Parc | 363/56 |
| 4,507,698 | 3/1985 | Nilssen | 361/42 |
| 4,525,648 | 6/1985 | De Bijl et al. | 315/224 |
| 4,572,988 | 2/1986 | Handler et al. | 315/209 |
| 4,608,958 | 9/1986 | Sakakibara et al. | 123/605 |
| 4,618,810 | 10/1986 | Hagerman et al. | 318/803 |
| 4,624,334 | 11/1986 | Kelledes et al. | 180/79.1 |
| 4,675,576 | 6/1987 | Nilssen | 315/242 |
| 4,682,083 | 7/1987 | Alley | 315/307 |
| 4,684,851 | 8/1987 | Van Meurs | 315/224 |
| 4,712,045 | 12/1987 | Van Meurs | 315/224 |
| 4,783,728 | 11/1988 | Hoffman | 363/37 |
| 4,818,917 | 4/1989 | Vest | 315/171 |
| 4,864,486 | 9/1989 | Spreen | 363/126 |
| 4,866,586 | 9/1989 | Suko | 363/5 |
| 4,870,327 | 9/1989 | Jorgensen | 315/307 |
| 4,899,382 | 2/1990 | Gartner | 379/413 |
| 4,952,853 | 8/1990 | Archer | 318/254 |
| 4,991,051 | 2/1991 | Hung | 361/57 |
| 5,003,231 | 3/1991 | Perper | 315/291 |
| 5,004,955 | 4/1991 | Nilssen | 315/119 |
| 5,014,305 | 5/1991 | Moisin | 379/402 |
| 5,027,032 | 6/1991 | Nilssen | 315/103 |
| 5,052,039 | 9/1991 | Moisin | 379/402 |
| 5,063,339 | 11/1991 | Orii et al. | 318/696 |
| 5,081,401 | 1/1992 | Moisin | 315/324 |
| 5,124,619 | 6/1992 | Moisin et al. | 315/219 |
| 5,138,233 | 8/1992 | Moisin et al. | 315/187 |
| 5,138,234 | 8/1992 | Moisin | 315/209 |
| 5,138,236 | 8/1992 | Bobel et al. | 315/209 |
| 5,144,195 | 9/1992 | Konopka et al. | 315/94 |

(List continued on next page.)

FOREIGN PATENT DOCUMENTS

| | | | |
|---|---|---|---|
| 0460641 | 12/1991 | European Pat. Off. . | |
| 0522266 | 1/1993 | European Pat. Off. . | |
| 4010435 | 2/1991 | Germany . | |
| 4032664 | 4/1992 | Germany . | |
| 63002464 | 11/1988 | Japan | H02H 9/08 |
| 2204455 | 11/1988 | United Kingdom . | |
| 9422209 | 9/1994 | WIPO . | |
| 9535646 | 12/1995 | WIPO . | |

OTHER PUBLICATIONS

"Simple Dimming Circuit for Fluorescent Lamp", IBM Technical Disclosure Bulletin, vol. 34, No. 4A, Sep. 1, 1991, pp. 109–111, XP000210848.

Marian Kazimierczuk et al., "*Resonant Power Converters*", 1995, pp. 332–333.

*Primary Examiner*—Don Wong
*Assistant Examiner*—Wilson Lee
*Attorney, Agent, or Firm*—Nutter, McClennen & Fish LLP

[57] ABSTRACT

A circuit including a rectifier having rectifying diodes has a feedback signal which provides substantially linear operation of the rectifying diodes. In one embodiment, a ballast circuit includes a rectifier circuit coupled to an inverter circuit which energizes a fluorescent lamp. The inverter circuit includes a ballast capacitor coupled to an inductive feedback element. The voltages generated across the ballast capacitor and the feedback element combine to provide a feedback signal that is effective to periodically bias at least one of the rectifying diodes to a conductive state during substantially the entire AC input signal. The substantially linear operation of the rectifying diodes enhances THD and PF performance of the circuit.

30 Claims, 6 Drawing Sheets

U.S. PATENT DOCUMENTS 5,434,480 7/1995 Bobel ..... 315/224
5,444,333 8/1995 Lau ..... 315/94
5,446,365 8/1995 Nomura et al. ..... 320/14
5,148,087 9/1992 Moisin et al. ..... 315/291
5,173,643 12/1992 Sullivan et al. ..... 315/276
5,177,408 1/1993 Marques ..... 315/291
5,191,263 3/1993 Konopka ..... 315/209
5,216,332 6/1993 Nilssen ..... 315/224
5,220,247 6/1993 Moisin ..... 315/209
5,223,767 6/1993 Kulka ..... 315/209 R
5,256,939 10/1993 Nilssen ..... 315/244
5,291,382 3/1994 Cohen ..... 363/56
5,309,066 5/1994 Ditlevsen ..... 315/205
5,313,143 5/1994 Vila-Masot et al. ..... 315/209 R
5,315,533 5/1994 Stich et al. ..... 364/480
5,332,951 7/1994 Turner et al. ..... 315/209
5,334,912 8/1994 Counts ..... 315/119
5,390,231 2/1995 Hung et al. ..... 379/2
5,399,943 3/1995 Chandrasekaran ..... 315/219
5,416,388 5/1995 Shackle ..... 315/219
5,432,817 7/1995 Hormel et al. ..... 375/257
5,434,477 7/1995 Crouse et al. ..... 315/209
5,481,160 1/1996 Nilssen ..... 315/209 R
5,493,180 2/1996 Bezdon et al. ..... 315/91
5,504,398 4/1996 Rothenbuhler ..... 315/209
5,515,433 5/1996 Chen ..... 379/398
5,557,176 9/1996 O'Brien ..... 315/209 R
5,563,479 10/1996 Suzuki ..... 318/139
5,574,335 11/1996 Sun ..... 315/119
5,579,197 11/1996 Mengelt et al. ..... 361/93
5,583,402 12/1996 Moisin et al. ..... 315/307
5,608,295 3/1997 Moisin ..... 315/247
5,608,595 3/1997 Gourab et al. ..... 361/79
5,638,266 6/1997 Horie et al. ..... 363/132
5,684,683 11/1997 Divan et al. ..... 33/65
5,686,799 11/1997 Moisin et al. ..... 315/307
5,691,606 11/1997 Moisin et al. ..... 315/224
5,798,617 8/1998 Moisin ..... 315/247
5,821,699 10/1998 Moisin ..... 315/291
5,825,136 10/1998 Rudolph ..... 315/291
5,831,395 11/1998 Mortimer et al. ..... 315/307
5,831,396 11/1998 Rudolph ..... 315/307
5,866,993 2/1999 Moisin ..... 315/307

BALLAST CIRCUIT WITH A CAPACITIVE AND INDUCTIVE FEEDBACK PATH

CROSS REFERENCE TO RELATED APPLICATIONS

Not Applicable.

STATEMENT REGARDING FEDERALLY-SPONSORED RESEARCH

Not Applicable.

FIELD OF THE INVENTION

The present invention relates to circuits for energizing a load and more particularly to circuits having a rectifier with linear operation of the rectifying diodes.

BACKGROUND OF THE INVENTION

There are many types of circuits for providing power to a load. One type of circuit is a rectifier circuit for receiving an alternating current (AC) signal and providing a direct current (DC) output signal. In one application, a ballast circuit for energizing a fluorescent lamp includes a rectifier circuit having an input coupled to an AC power source and a DC output coupled to an inverter circuit. The inverter circuit applies an AC signal to the lamp that is effective to cause a predetermined level of current to flow through the lamp and thereby produce visible light.

Rectifier circuits generally contain one or more rectifying diodes coupled so as to form the input (AC) side and the output (DC) side of the rectifier. Each of the rectifying diodes is conductive for a part of the AC input signal. For example, a first rectifying diode may be conductive for a part of the positive portion of the AC input signal and a second rectifying diode may be conductive for a part of the negative portion. One problem associated with this arrangement is that the diodes which form the rectifier circuit are not conductive, when the AC input signal is at or near its peak value. The non-linear operation of the rectifying diodes has a negative impact on the efficiency of the circuit since only a limited amount of power from the AC power source is available to the circuit. Further, the total harmonic distortion (THD) and the Power Factor (PF) of the circuit are also adversely affected.

It would, therefore, be desirable to provide a circuit including a rectifier circuit having rectifying diodes that are operated in a substantially linear manner.

SUMMARY OF THE INVENTION

The present invention provides a circuit including a rectifier having rectifying diodes that operate in a substantially linear manner. Although the circuit is primarily shown and described in conjunction with a ballast circuit having a rectifier circuit coupled to an inverter circuit, it is understood that the circuit is applicable to other circuits and loads, such as power supplies and DC motors.

The circuit includes a rectifier having rectifying diodes with a feedback signal coupled to at least one of the rectifying diodes for providing substantially linear diode operation. In general, the relatively high frequency feedback signal comprises a voltage generated by a series resonance between an inductive element and a capacitive element which form a part of the circuit. The feedback signal is effective to periodically bias at least one of the rectifying diodes to a conductive state over substantially the entire AC input waveform. More particularly, a first rectifying diode transitions between a conductive and non-conductive state many times during a positive portion of the relatively low frequency AC input signal. And a second rectifying diode transitions to a conductive state many times during a negative portion of the AC input cycle. The linear operation of the rectifying diodes improves the power factor of the circuit and reduces the total harmonic distortion as compared with non-linear diode operation.

In one embodiment, a ballast circuit includes a rectifier which receives a relatively low frequency AC input signal and provides a DC signal to an inverter circuit. The inverter circuit applies a relatively high frequency AC signal to a lamp for causing a predetermined amount of current to flow through the lamp and thereby emit visible light. In an exemplary embodiment, the rectifier has a voltage doubler configuration including first and second rectifying diodes. The inverter circuit includes first and second switching elements coupled in a half bridge configuration connected to a resonant inductive element which is coupled to the lamp. A second inductive element, which is inductively coupled with the first inductive element, is coupled to a ballast capacitor.

The ballast capacitor and the first and second inductive elements resonate in series such that the respective voltages across the ballast capacitor and the second inductive element combine to provide a feedback signal that is effective to periodically bias a respective one of the first and second rectifying diodes to a conductive state. The first rectifying diode transitions between a conductive and non-conductive state when the input AC signal is positive and the second rectifying diode transitions between the conductive and non-conductive state when the input AC signal is negative. The frequency associated with transitions of the rectifying diodes between conductive and non-conductive states corresponds to a frequency of the AC signal that is applied to the lamp. Thus, a respective one of the first and second rectifying diodes is periodically biased to a conductive state over substantially the entire AC input signal to provide substantially linear diode operation.

In another embodiment, a ballast circuit includes a rectifier having a voltage doubler configuration coupled to an inverter circuit for energizing a lamp. The inverter circuit has a full bridge topology formed from first and second switching elements and first and second bridge diodes. Coupled to the bridge are first and second inductive elements which are adapted for connection to the lamp. The inverter further includes a ballast capacitor and a third inductive element which is inductively coupled to the first and second inductive elements.

In operation, the first switching element is conductive as current flows in a first direction through the lamp and the second inductive element. The second switching element is conductive as current flows in a second, opposite direction through the lamp and the first inductive element. The ballast capacitor resonates in series with the first and second inductive elements and a corresponding voltage is induced in the third inductive element. The voltages across the ballast capacitor and the third inductive element combine to provide a feedback signal to the rectifying diodes that is effective to periodically bias a respective one of the first and second rectifying diodes to a conductive state.

In a further embodiment, the inverter circuit has a full bridge topology and the rectifier is a full bridge rectifier including four rectifying diodes with first and second capacitors coupled end to end across AC input terminals of the rectifier. A feedback signal from the inverter is coupled to a point between the first and second capacitors. The feedback signal periodically biases a respective pair of the rectifying diodes to a conductive state to provide substantially linear operation of the four rectifying diodes.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
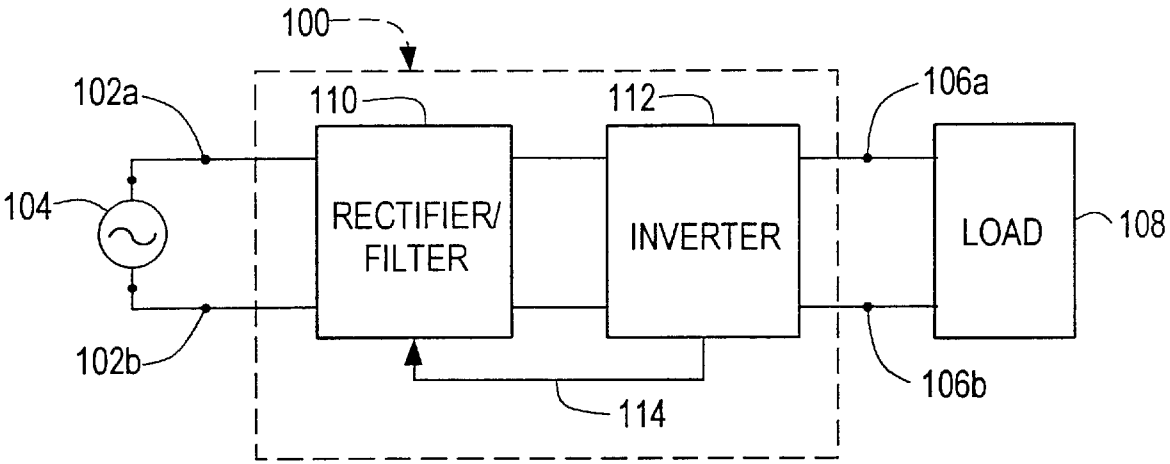
FIG. 1 is a schematic block diagram of a circuit in accordance with the present invention.

FIG. 1 shows an exemplary embodiment of a ballast circuit 100 in accordance with the present invention. The ballast circuit 100 includes first and second input terminals 102*a,b* coupled to an alternating current (AC) power source 104 and first and second output terminals 106*a,b* coupled to a load 108, such as a fluorescent lamp. The ballast circuit 100 has a rectifier/filter circuit 110 for receiving the AC signal from the power source 104 and providing a direct current (DC) signal to an inverter circuit 112. The inverter circuit 112 provides a feedback signal 114 to the rectifier circuit 110 for enhancing linear operation of the rectifier, as described below. The inverter circuit 112 energizes the lamp 108 with an AC signal that is effective to cause a current to flow through the lamp and thereby emit light.

Figure 2:
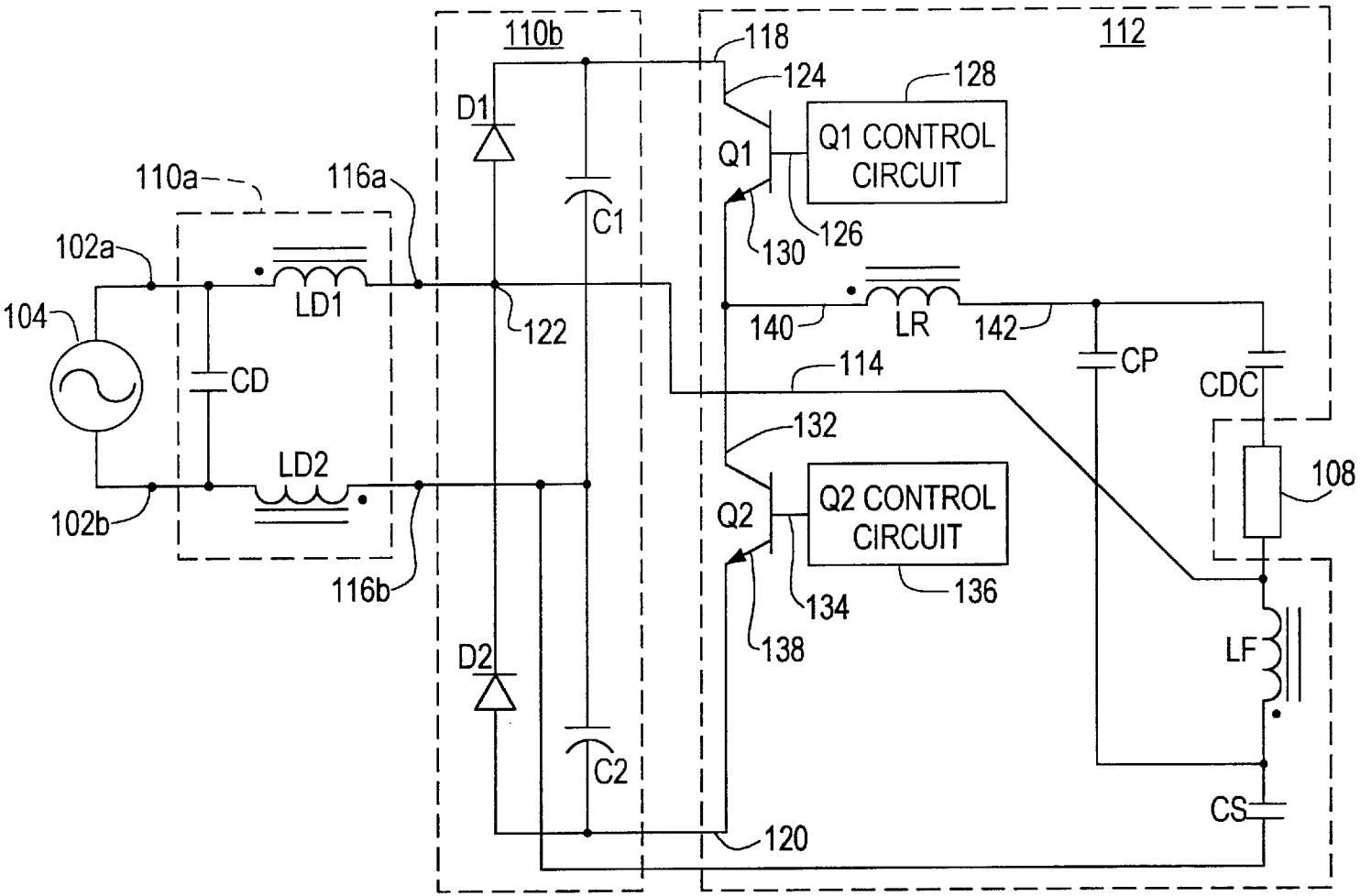
FIG. 2 is a circuit diagram of an exemplary embodiment of the circuit of FIG. 1.

FIG. 2 is an exemplary embodiment of the ballast circuit 100 of FIG. 1, wherein like reference designations indicate like elements. An electromagnetic interference (EMI) filter 110*a* has first and second input terminals 102*a*, 102*b* coupled to the AC energy source 104 and first and second output terminals 116*a*, 116*b* coupled to the rectifier circuit 110*b*. The EMI filter 110*a* includes a filter capacitor CD coupled across the filter input terminals 102*a,b* and inductively coupled first and second inductive elements LD1,LD2 coupled to opposite terminals of the capacitor CD.

The rectifier circuit 110*b* is configured as a so-called voltage doubler circuit formed from rectifying diodes D1,D2 and capacitors C1,C2. Voltage doubler circuits are well known to one of ordinary skill in the art. The diodes D1,D2 are coupled end to end across positive and negative rails 118,120 of the inverter 112. The capacitors C1,C2 are also coupled end to end across the positive and negative rails 118,120. The rectifier 110*b* further includes a feedback node 122 located at a point between the first and second diodes D1,D2. The feedback node 122 receives a feedback signal from the inverter 112 via a feedback path 114. The feedback signal is effective to provide substantially linear operation of the rectifying diodes D1,D2, as described below.

The inverter circuit 112 includes first and second switching elements Q1,Q2, shown here as transistors, coupled in a half bridge configuration between the positive and negative rails 118,120 of the inverter. It is understood by one of ordinary skill in the art that other types of switching elements can be used. In an exemplary embodiment, the first switching element Q1 includes a first or collector terminal 124 coupled to the positive rail 118, a second or base terminal 126 coupled to a first control circuit 128 for controlling the conduction state of the first switching element Q1, and a third or emitter terminal 130 coupled to the second switching element Q2. The second switching element Q2 has a collector terminal 132 coupled to the emitter terminal 130 of the first switching element Q1, a base terminal 134 coupled to a second control circuit 136 for controlling a conduction state of the second switching element Q2, and an emitter terminal 138 coupled to the negative rail 120 of the inverter.

A resonant inductive element LR has a first terminal 140 coupled to a point between the first and second switching elements Q1,Q2 and a second terminal 142 which is coupled to both a parallel capacitor CP and a DC-blocking capacitor CDC. The capacitor CDC, the lamp 108, an inductive feedback element LF, and a ballast capacitor CS are consecutively coupled between the inductive element LR and a point between the capacitors C1,C2 (AC ground). The parallel capacitor CP has one terminal coupled to a point between the inductive element LR and the capacitor CDC and the other terminal coupled to a point between the feedback element LF and the ballast capacitor CS. The feedback path 114 extends from a point between the lamp 108 and the feedback element LF to the feedback node 122, which is located between the rectifying diodes D1,D2.

The feedback element LF is inductively coupled with the inductive element LR with respective polarities indicated with conventional dot notation. As understood by one of ordinary skill in the art, the dot indicates a rise in voltage from the unmarked end to the marked end.

In operation, the rectifier 110*b* receives a relatively low frequency AC input signal from the AC energy source 104 and provides a DC signal to the inverter circuit 112 which energizes the lamp 108 with a relatively high frequency AC signal. The first rectifying diode D1 is conductive for a portion of a positive half of the AC input signal and the second diode D2 is conductive for a portion of a negative half of the AC signal. When the diodes D1,D2 are conductive, energy from the AC source 104 is transferred to the circuit. Voltages at the feedback element LF and the ballast capacitor CS combine to form the feedback signal that is provided to the rectifying diodes D1,D2 at the feedback node 122 via the feedback path 114.

The inverter 112 provides a relatively high frequency AC signal to the lamp 108 so as to cause a predetermined amount of current to flow through the lamp and thereby emit visible light. The inverter 112 has a characteristic resonant frequency which is determined by the impedance values of the various circuit elements, such as the inductive element LR, the capacitors CP,CS and the lamp 108. As the circuit resonates, current through the lamp 108 and the other circuit elements periodically reverses direction. In general, as current flows in a first direction from the inductive element LR to the lamp 108, the first switching element Q1 is conductive. And when the current reverses direction so as to flow from the lamp 108 to the inductive element LR, the second switching element Q2 is conductive. The first and second control circuits 128,136 control the conduction states of the respective first and second switching elements Q1,Q2 so as facilitate resonant operation of the circuit. Control circuits for controlling the switching elements Q1,Q2 are well known to one of ordinary skill in the art. Exemplary control circuits for controlling the switching elements Q1,Q2 are disclosed in U.S. Pat. Nos. 5,124,619 (Moisin et al.), 5,138,234 (Moisin), and 5,138,236 (Bobel et al.), all incorporated herein by reference.

Substantially linear operation of the rectifying diodes D1,D2 is achieved due to voltages at the capacitor CS and feedback element LF which combine to provide the feedback signal. As current flows through the resonant inductive element LR a voltage is induced at the inductively coupled feedback element LF. In addition, a local series resonance develops between the ballast capacitor CS and the inductive elements LF,LR. As known to one of ordinary skill in the art, a series resonant inductive-capacitive (LC) circuit appears as a short circuit. However, voltages across the inductive and capacitive elements can be relatively high. And due the phase relationship of the respective voltages across the capacitor CS and inductor LF, the voltages combine to apply a voltage at the feedback node 122 via the feedback path 114 that periodically biases one of the rectifying diodes D1,D2 to a conductive state.

Figure 3:
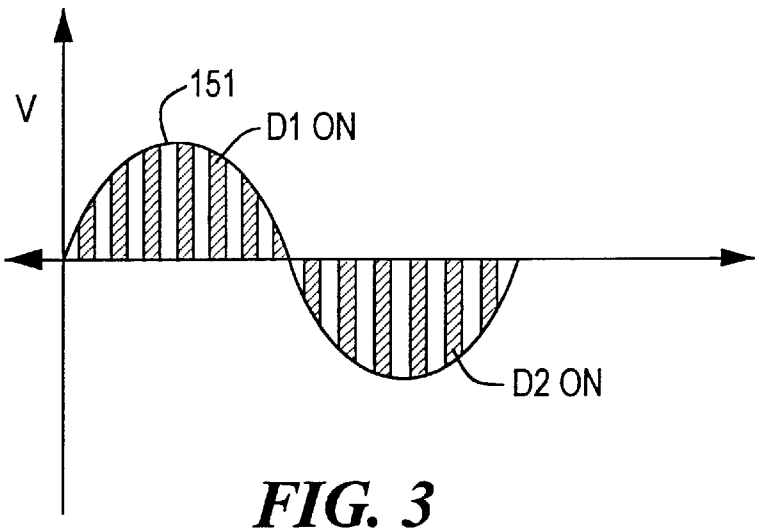
FIG. 3 is a graphical depiction of exemplary signals generated by the circuit of FIG. 1.

As shown in FIG. 3, the first diode D1 is periodically forward biased (ON) during a positive half cycle of the AC input signal 151 and the second diode D2 is periodically biased to a conductive state (ON) during a negative half cycle of the input signal. The first diode D1 transitions between the conductive and non-conductive states many times during each positive portion of the AC input signal. And similarly, the second diode D2 periodically conducts during the negative portion of the AC input signal. This reflects the relationship of the relatively high frequency AC signal applied to the lamp 108 and the relatively low frequency, e.g., 60 Hz, of the AC input signal provided by the AC source 104. It is understood that the graphical depiction of FIG. 3 is not intended to show any particular relationship between the respective frequencies of the signals but rather is intended to facilitate an understanding of the invention.

By causing the rectifying diodes D1,D2 to operate linearly, the total harmonic distortion (THD) is reduced and the power factor (PF) is improved. The circuit provides a THD of less than about twenty percent and a PF of greater than about ninety-five percent. And since the diodes conduct over substantially the entire AC input signal, more power comes directly from the power line instead of from a circuit element in which the energy had been stored.

Figure 4:
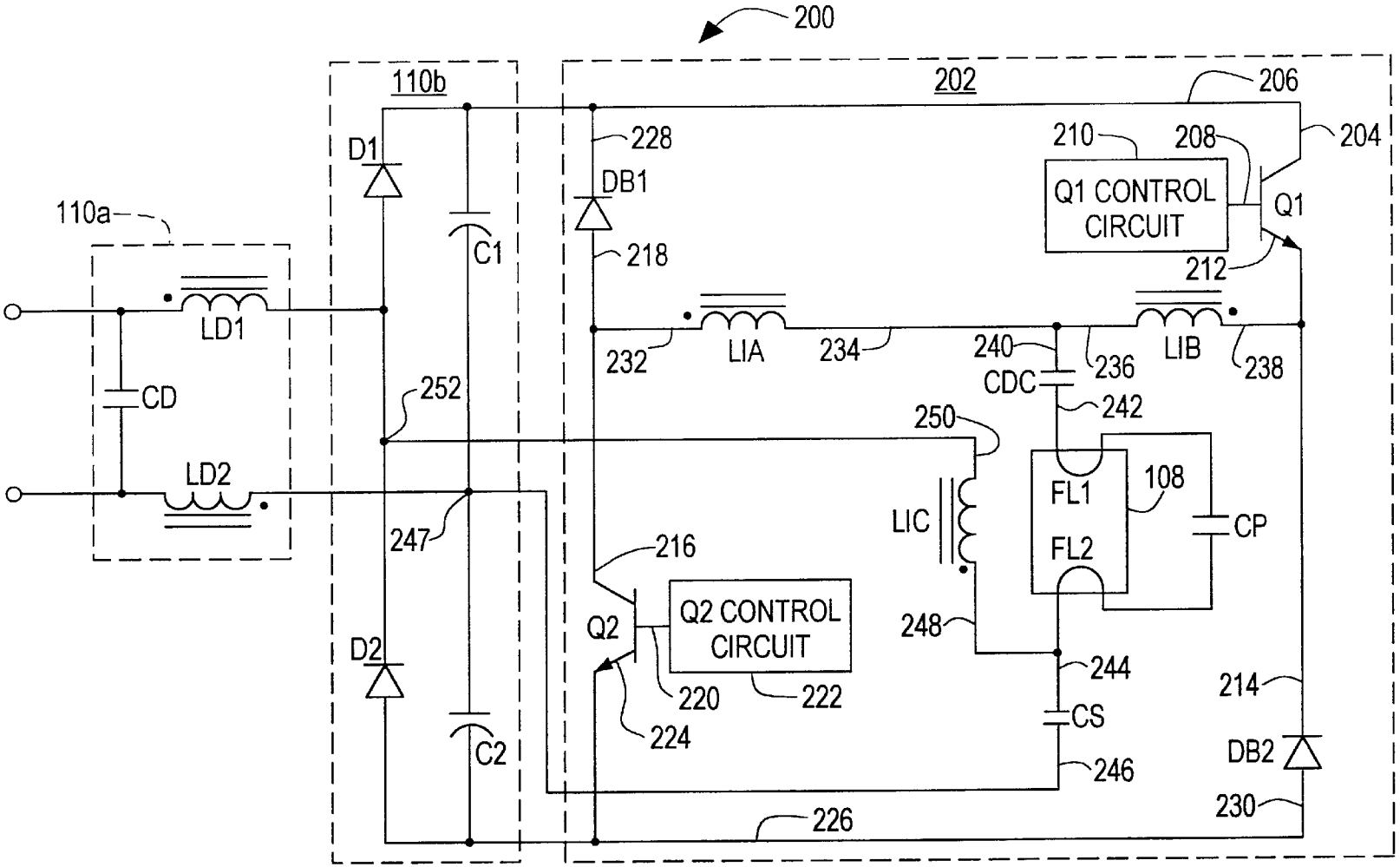
FIG. 4 is a circuit diagram of another embodiment of the circuit of FIG. 1.

FIG. 4 shows another embodiment of a ballast circuit 200 having feedback in accordance with the present invention. The ballast circuit 200 includes an EMI filter 110*a* and a rectifier 110*b* like that shown in FIG. 2. The ballast circuit 200 includes an inverter circuit 202 having a full bridge topology with first and second switching elements Q1,Q2, first and second bridge diodes DB1,DB2, and first and second inductively coupled inductive elements L1A,L1B. The first switching element Q1, shown as a transistor, has a collector terminal 204 coupled to a positive rail 206 of the inverter, a base terminal 208 coupled to a first control circuit 210, and an emitter terminal 212 coupled to a cathode 214 of the second diode DB2. The second switching element Q2, also shown as a transistor, has a collector terminal 216 coupled to an anode 218 of the first diode DB1, a base terminal 220 coupled to a second control circuit 222, and an emitter terminal 224 coupled to a negative rail 226 of the inverter. A cathode 228 of the first bridge diode DB1 is connected to the positive rail 206 of the inverter and an anode 230 of the second bridge diode DB2 is connected to the negative rail 226.

The first inductive element L1A has a first terminal 232 coupled to a point between the first bridge diode DB1 and the second switching element Q2 and a second terminal 234 coupled to a first terminal 236 of the second inductive element L1B. A second terminal 238 of the second inductive element L1B is coupled to a point between the first switching element Q1 and the second bridge diode D2. A DC-blocking capacitor CDC is coupled at a first terminal 240 to a point between the first and second inductive elements L1A,L1B and at a second terminal 242 to a first lamp filament FL1. The parallel capacitor CP is coupled across the first lamp filament F11 and a second lamp filament FL2. A ballast capacitor CS has a first terminal 244 coupled to the second filament FL2 and a second terminal 246 coupled to a point 247 between the capacitors C1,C2, which is AC ground. A feedback inductive element L1C has a first terminal 248 coupled to a point between the ballast capacitor CS and the second lamp filament FL2 and a second terminal 250 coupled to a feedback node 252 located between the first and second rectifyiing diodes D1,D2. The feedback inductive element L1C is inductively coupled with the first and second inductive elements L1A,L1B with a polarity as indicated with dot notation.

Resonant operation of the full bridge circuit is described in co-pending and commonly assigned U.S. patent application Ser. No. 08/948,690, filed on Oct. 10, 1997, and entitled Converter/Inverter Full Bridge Ballast Circuit. In general, the first and second switching elements Q1,Q2 are alternately conductive as current periodically switches direction. The bridge diodes DB1,DB2 provide a discharge path during the time when both the first and second switching elements are OFF, i.e., the dead time.

Looking at the time when the first switching element Q1 is ON, current flows from the transistor Q1, through the second inductive element L1B, the capacitor CDC, the lamp 108, and the ballast capacitor CS to AC ground 247. As the current flows, the second inductive element L1B and the ballast capacitor CS begin to resonate in a local LC series resonance. As described above, relatively high voltages can appear at the capacitive and inductive elements due to the resonance. The voltage at the second inductive element L1B induces a corresponding voltage at the inductively coupled feedback inductive element L1C. And due to the phase relationship of the voltages at the ballast capacitor CS and the inductive feedback element L1C, the voltages combine to provide a voltage at the feedback node 252 that is effective to periodically bias the second rectifying diode D2 to a conductive state.

When the current flows in the opposite direction as the second switching element Q2 is conductive, the polarity of the voltage at the feedback inductive element L1C switches since now current flows from the lamp 108 to the first inductive element L1A. The voltages at the ballast capacitor CS and the feedback element L1C combine to periodically bias the first rectifying diode D1 to the conductive state. Referring again to FIG. 3, one of the rectifying diodes D1,D2 is periodically ON over the entire low frequency AC input waveform to provide linear diode operation.

Figure 5:
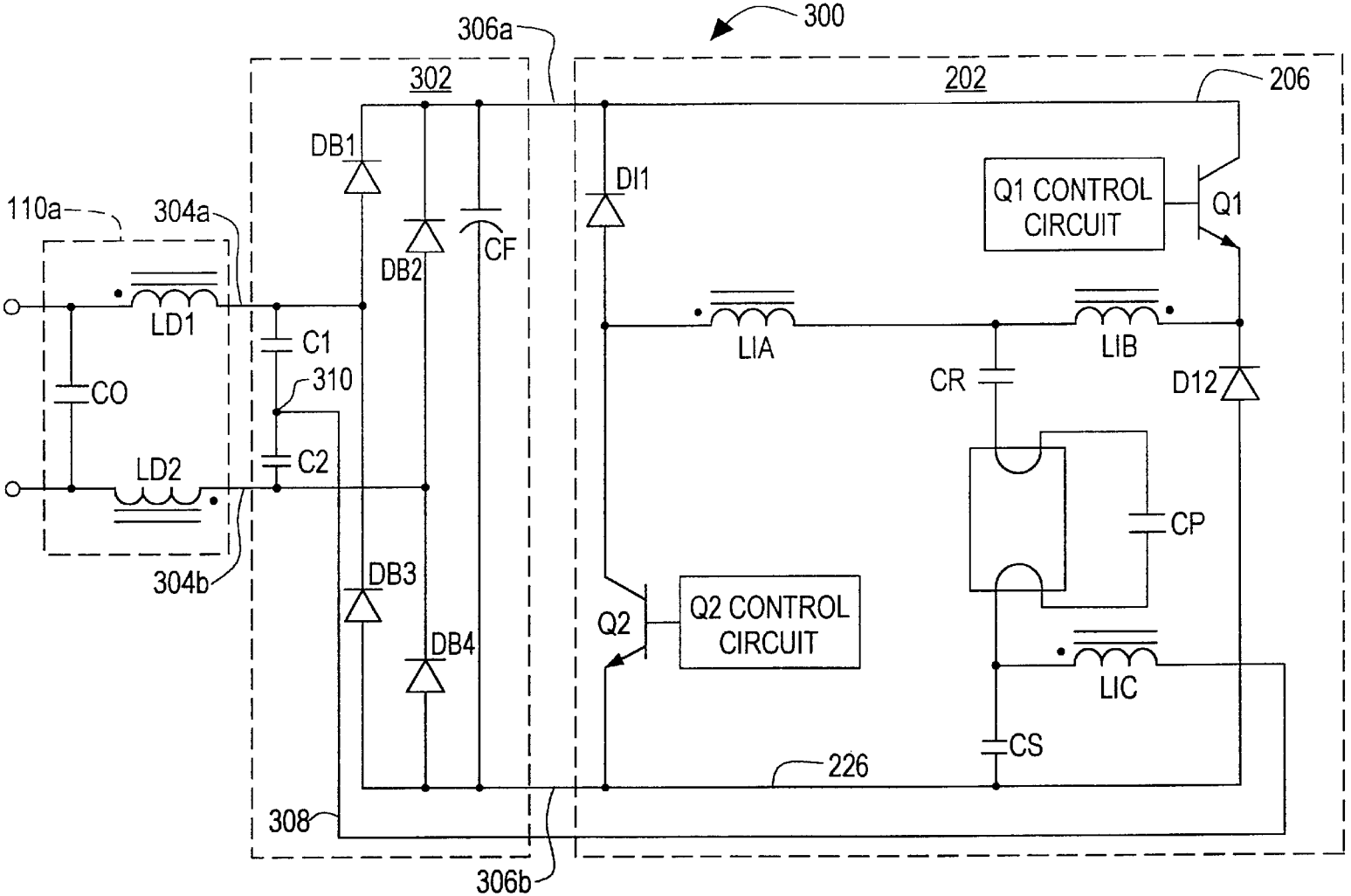
FIG. 5 is a circuit diagram of a further embodiment of the circuit of FIG. 1.

FIG. 5 shows a further embodiment of a ballast circuit 300 in accordance with the present invention. The ballast circuit 300 includes an EMI filter 110*a* like that shown in FIG. 2 and a full bridge inverter circuit 202 like that shown in FIG. 4. Coupled to the EMI filter 110*a* is a rectifier circuit 302 having first and second capacitors C1,C2 coupled end to end across first and second AC input terminals 304*a*,304*b* of the rectifier 302. The rectifier circuit 302 further includes rectifying diodes D1–D4 coupled in a full bridge configuration forming first and second DC output terminals 306*a*,306*b* which are coupled to the positive and negative rails 206,226, respectively, of the inverter 202.

A feedback path 308 from the ballast capacitor CS and the feedback inductive element L1C is coupled to a feedback node 310 located between the first and second capacitors C1,C2, which is AC ground.

As described above in conjunction with FIG. 4, the first and second inductive elements L1A, L1B and the ballast capacitor CS resonate in series such that a relatively high voltage appears across the feedback element L1C. The voltages at the ballast capacitor CS and the feedback element L1C combine to provide a feedback signal that is effective to periodically bias one or more of the rectifying diodes D1–D4 to a conductive state and thereby provide substantially linear diode operation. More particularly, during a positive portion of the AC input signal, the first and fourth rectifying diodes D1,D4 repeatedly transition between a conductive and non-conductive state. Similarly, the second and third rectifier diodes D2,D3 periodically conduct during the negative portion of the AC input signal.

Figure 6:
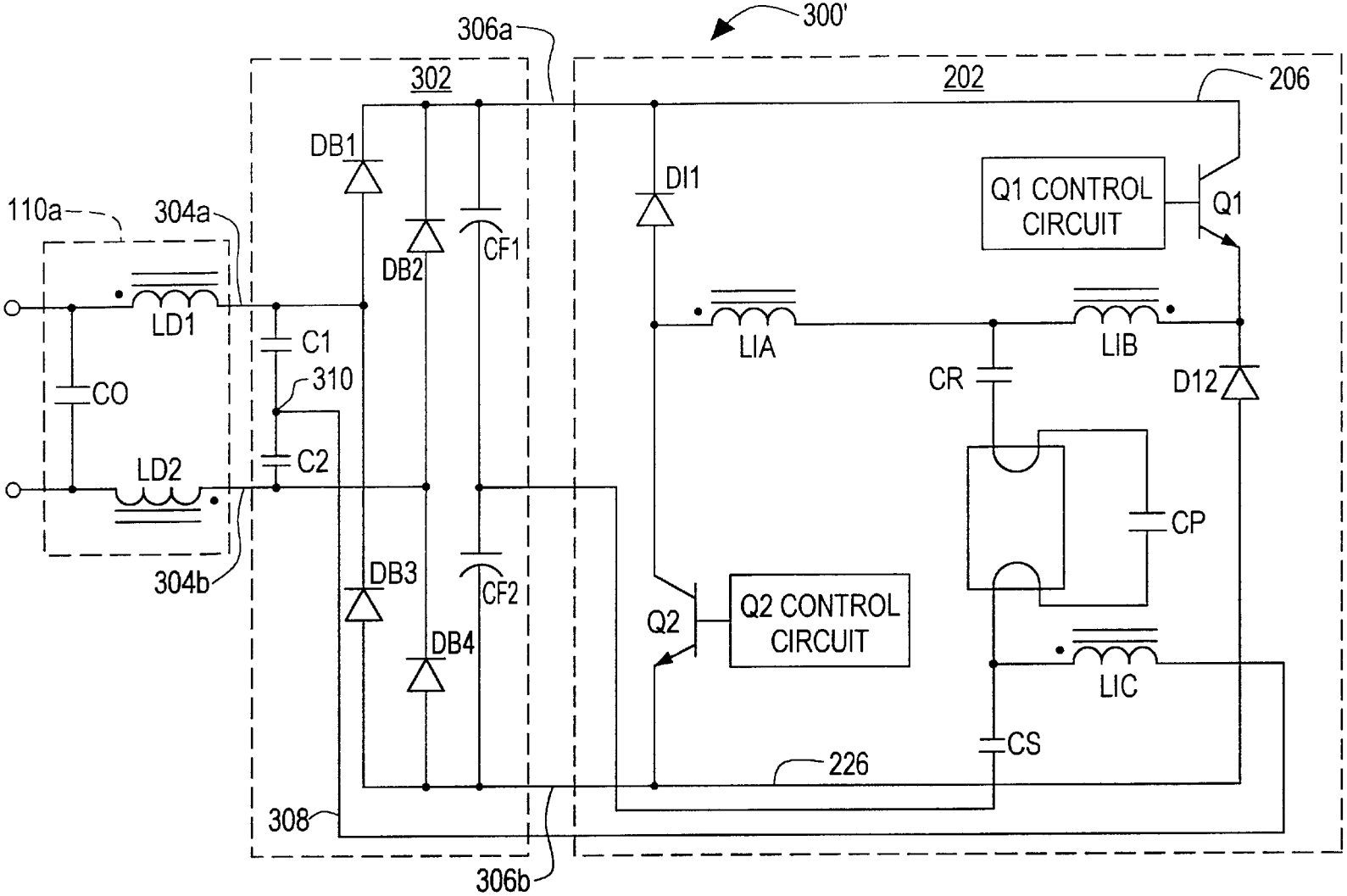
FIG. 6 is a circuit diagram of a still further embodiment of the circuit of FIG. 1.

FIG. 6 shows a ballast circuit 300' like that shown in FIG. 5 with a second capacitor CF2 coupled end to end with the first capacitor CF1 between the output terminals 306 of the rectifier 302. A circuit path extends from the ballast capacitor CS to a point between the capacitors CF1,CF2 (AC ground).

Figure 7:
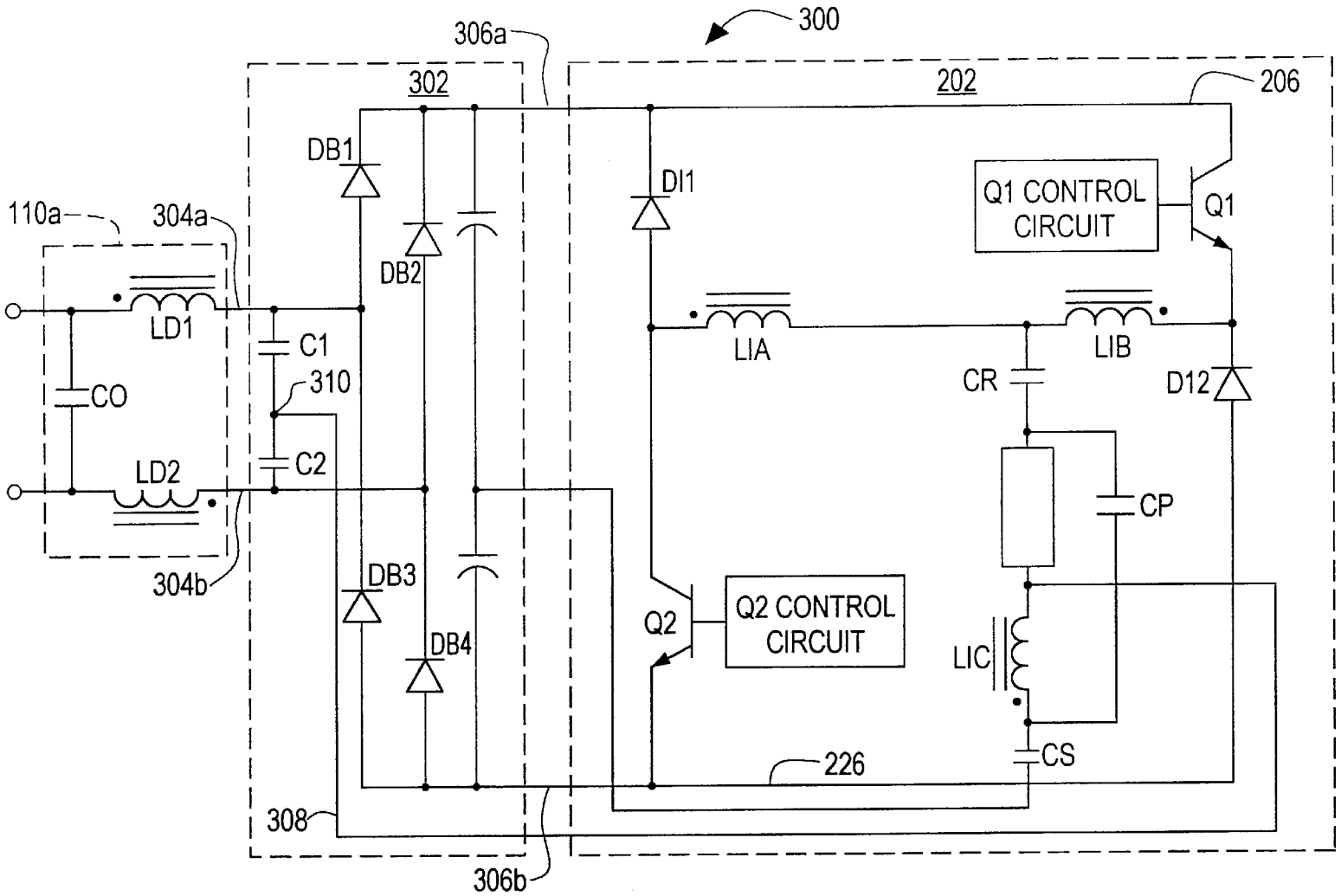
FIG. 7 is a circuit diagram of another embodiment of the circuit of FIG. 1.

FIG. 7 shows a ballast circuit 300" like that shown in FIG. 5 with the feedback element L1C coupled between the lamp and the ballast capacitor CS. As described above in conjunction with FIGS. 2 and 4, the ballast capacitor CS and the inductive elements L1A,L1B,L1C resonate in series so as to generate a voltage that is sufficient to bias the rectifying diodes into substantially linear diode operation.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A circuit including a rectifier having at least one rectifying diode, the circuit comprising:

a first inductive element; and a capacitor coupled to the first inductive element such that the capacitor and the first inductive element resonate in series and generate a feedback signal that is effective to periodically bias the at least one rectifying diode to a conductive state.

2. The circuit according to claim 1, wherein the rectifier has an AC input side for receiving an AC input signal and a DC output side and the feedback signal is applied to the input side of the rectifier via a feedback path.

3. The circuit according to claim 2, wherein the at least one rectifying diode includes first and second diodes coupled end to end and the feedback signal is applied to a point between the first and second rectifying diodes.

4. The circuit according to claim 3, wherein the first diode is periodically conductive during a positive portion of the AC input signal and the second diode is periodically conductive during a negative portion of the AC input signal.

5. The circuit according to claim 3, wherein the rectifier circuit has a voltage doubler configuration.

6. The circuit according to claim 2, wherein the at least one rectifying diode includes four diodes coupled in a full bridge configuration.

7. The circuit according to claim 1, further including an inverter circuit coupled to the rectifier circuit.

8. The circuit according to claim 7, wherein the inverter circuit is adapted for energizing a lamp and the feedback signal comprises a voltage at a point between the first inductive element and the lamp.

9. The circuit according to claim 7, wherein the inverter circuit includes a second inductive element inductively coupled to the first inductive element such that the capacitor resonates with the second inductive elment.

10. The circuit according to claim 1, wherein the rectifier includes an AC input for receiving an AC input signal and a DC output and the at least one rectifying diode includes first and second diodes such that the feedback signal is effective to periodically bias the first diode to a conductive state during a positive portion of the AC input signal and to periodically bias the second diode to a conductive state during a negative portion of the AC input signal.

11. A ballast circuit for energizing a lamp, comprising:

a rectifier circuit including first and second rectifying diodes, the rectifier circuit having an AC input adapted for receiving an AC input signal and a DC output;

an inverter circuit coupled to the DC output of the rectifier circuit, the inverter circuit providing a feedback signal to the rectifier circuit at a point between the first and second rectifying diodes via a feedback path, the inverter circuit including at least one switching element;

a first inductive element coupled to the at least one switching element, the first inductive element adapted for coupling to the lamp;

a second inductive element inductively coupled to the first inductive element, the second inductive element being adapted for coupling to the lamp; and a ballast capacitor coupled to the second inductive element;

wherein the feedback path is coupled to a point between the second inductive element and the lamp.

12. The ballast circuit according to claim 11, wherein the first inductive element, the lamp, the second inductive element and the ballast capacitor form a series circuit path.

13. The ballast circuit according to claim 12, wherein the ballast capacitor and the second inductive element have respective impedance values such that the ballast capacitor and the second inductive element resonate in series.

14. The ballast circuit according to claim 13, wherein the feedback signal comprises voltages appearing at the second inductive element and the ballast capacitor such that the feedback signal is effective to periodically bias the first and second rectifying diodes to a conductive state.

15. The ballast circuit according to claim 14, wherein the first rectifying diode is periodically conductive during a positive portion of the AC input signal and the second rectifying diode is periodically conductive during a negative portion of the AC input signal.

16. The ballast circuit according to claim 15, wherein the feedback signal is effective to periodically bias the first and second rectifying diodes to a conductive state during substantially an entire cycle of the AC input signal.

17. A ballast circuit for energizing a lamp, comprising;

a rectifier circuit including first and second rectifying diodes, the rectifier circuit having an AC input adapted for receiving an AC input signal and a DC output;

an inverter circuit coupled to the DC output side of the rectifier circuit, the inverter circuit providing a feedback signal to the rectifier circuit at a point between the first and second rectifying diodes via a feedback path, the inverter circuit including at least one switching element;

first and second inductive elements coupled to the at least one switching element;

a ballast capacitor for coupling to the lamp; and an inductive feedback element inductively coupled to the first and second inductive elements, wherein the feedback path includes the inductive feedback element such that the feedback path extends from the point between the first and second rectifying diodes to the ballast capacitor.

18. The ballast circuit according to claim 17, wherein the inverter circuit has a full bridge configuration.

19. The ballast circuit according to claim 18, wherein the first and second inductive elements resonate in series with the ballast capacitor.

20. The ballast circuit according to claim 19, wherein voltages at the feedback element and the ballast capacitor are effective to periodically bias the first and second rectifying diodes to a conductive state.

21. The ballast circuit according to claim 17, wherein the first and second rectifying diodes are operable in a substantially linear manner.

22. The ballast circuit according to claim 17, wherein the first rectifying diode is periodically conductive during a positive portion of the AC input signal and the second rectifying diode is periodically conductive during a negative portion of the AC input signal.

23. A ballast circuit for energizing a lamp, comprising:

a rectifier circuit having first, second, third and fourth rectifying diodes coupled in a full bridge configuration, the rectifier having first and second AC input terminals for receiving an AC input signal and a DC output, the rectifier further including first and second capacitors coupled end to end between the first and second AC input terminals;

a full bridge inverter circuit coupled to the DC output of the rectifier, the inverter circuit including at least one switching element;

first and second inductive elements coupled to the at least one switching element;

a ballast capacitor for coupling to the lamp;

an inductive feedback element inductively coupled to the first and second inductive elements, the feedback inductive element being coupled to the ballast capacitor and to a point between the first and second capacitors.

24. The ballast circuit according to claim 23, wherein the ballast capacitor and the first and second inductive elements resonate in series.

25. The ballast circuit according to claim 24, wherein voltages at the feedback element and the ballast capacitor combine to periodically bias each of the rectifying diodes to a conductive state.

26. The ballast circuit according to claim 25, wherein operation of the rectifying diodes is substantially linear.

27. The ballast circuit according to claim 25, wherein the inverter applies an AC signal to the lamp such that a frequency of the AC lamp signal is greater than a frequency of the AC input signal.

28. The ballast circuit according to claim 27, wherein first and second ones of the rectifying diodes are periodically conductive during a positive portion of the AC input cycle and third and fourth ones of the rectifying diodes are conductive during a negative portion of the AC input cycle.

29. The ballast circuit according to claim 28, wherein respective ones of the rectifying diodes are periodically conductive during substantially an entire cycle of the AC input signal.

30. A ballast circuit for energizing a lamp, comprising:

a rectifier circuit having first, second, third and fourth rectifying diodes coupled in a full bridge configuration, the rectifier having first and second AC input terminals for receiving an AC input signal and a DC output, the rectifier further including first and second capacitors coupled end to end between the first and second AC input terminals;

a full bridge inverter circuit coupled to the DC output of the rectifier, the inverter circuit including at least one switching element;

first and second inductive elements coupled to the at least one switching element;

a ballast capacitor for coupling to the lamp; and an inductive feedback element inductively coupled to the first and second inductive elements, the feedback inductive element, the lamp and the ballast capacitor being coupled so as to form a series circuit path, wherein a feedback path extends from a point between the first and second capacitors to a point between the lamp and the feedback element.

* * * * *